US007559824B2

(12) United States Patent
Park et al.

(10) Patent No.: US 7,559,824 B2
(45) Date of Patent: Jul. 14, 2009

(54) CHEMICAL MECHANICAL POLISHING DEVICES, PAD CONDITIONER ASSEMBLY AND POLISHING PAD CONDITIONING METHOD THEREOF

(75) Inventors: Moo-yong Park, Yongin-si (KR); Tai-hyoung Kim, Yongin-si (KR); Choon-goang Kim, Hwaseong-si (KR); Dong-Il Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/494,613

(22) Filed: Jul. 28, 2006

(65) Prior Publication Data

US 2007/0077871 A1 Apr. 5, 2007

(30) Foreign Application Priority Data

Jul. 28, 2005 (KR) ..... 10-2005-0069129

(51) Int. Cl.
*B24B 53/00* (2006.01)

(52) U.S. Cl. ..... 451/11; 451/443; 451/56

(58) Field of Classification Search ..... 451/11, 451/443, 444, 288, 287, 56, 72
See application file for complete search history.

(56) References Cited

U.S. PATENT DOCUMENTS 5,245,790 A * 9/1993 Jerbic ..... 451/159
5,245,796 A * 9/1993 Miller et al. ..... 451/41
5,531,861 A * 7/1996 Yu et al. ..... 438/693
5,752,423 A * 5/1998 Rawson ..... 83/508.3
5,904,615 A * 5/1999 Jeong et al. ..... 451/443
6,083,085 A * 7/2000 Lankford ..... 451/56
6,241,588 B1 * 6/2001 Brown et al. ..... 451/56
6,547,651 B1 * 4/2003 Boyd et al. ..... 451/285
6,666,749 B2 * 12/2003 Taylor ..... 451/6
6,878,045 B2 4/2005 Janzen
7,033,246 B2 * 4/2006 Elledge et al. ..... 451/5

FOREIGN PATENT DOCUMENTS

JP 2000-288914 10/2000
KR 1998-068051 10/1998
KR 10-2003-0053375 6/2003

OTHER PUBLICATIONS

Korean Office Action dated Aug. 30, 2006 for counterpart Korean Application No. 10-2005-0069129 with English translation.

* cited by examiner

*Primary Examiner*—Robert Rose
(74) *Attorney, Agent, or Firm*—Harness, Dickey & Pierce, P.L.C.

(57) ABSTRACT

Chemical mechanical polishing (CMP) devices, a pad conditioner assembly and a polishing pad conditioning method thereof are provided. The CMP device planarizes a wafer by rotating a carrier, which has a wafer mounted on a lower surface of the carrier, over a rotating polishing table while supplying a slurry onto a polishing pad attached to an upper surface of the rotating polishing table. The CMP device may include a pad conditioner assembly that conditions the polishing pad by supplying a pad conditioning liquid onto the polishing pad and simultaneously transferring a megasonic vibration to the pad conditioning liquid to remove foreign substances from a surface of the polishing pad.

35 Claims, 6 Drawing Sheets

CHEMICAL MECHANICAL POLISHING DEVICES, PAD CONDITIONER ASSEMBLY AND POLISHING PAD CONDITIONING METHOD THEREOF

PRIORITY STATEMENT

This application claims the benefit of priority under 35 U.S.C. § 119 from Korean Patent Application No. 10-2005-69129, filed on Jul. 28, 2005 in the Korean Intellectual Property Office, the disclosure of which is incorporated herein by reference in its entirety.

BACKGROUND OF THE INVENTION

1. Field of the Invention

Example embodiments of the present invention relate to a semiconductor manufacturing device and a maintenance method thereof. Other example embodiments of the present invention relate to chemical mechanical polishing (CMP) devices capable of performing a pad conditioning operation using megasonic waves, a pad conditioner assembly and a polishing pad conditioning method thereof.

2. Description of the Related Art

It is well-known in the art of semiconductor manufacturing processing that a chemical mechanical polishing (CMP) process may be used as a planarization process. In general (as illustrated in FIG. 1), a CMP process may be performed using a CMP device that includes a carrier 15 and a polishing table 11. A wafer W may be mounted on the carrier 15. A polishing pad 13 may be attached to the polishing table 11. In the CMP process, when the wafer W is mounted onto the carrier 15, the carrier 15 may rotate such that the wafer W contacts the polishing table 11. While the polishing table 11 is rotating, wafer W may be pressed onto and simultaneously moved over the polishing table 11, having the polishing pad 13 attached thereon. As such, the wafer W may be polished and planarized. It may be necessary to use a slurry 17 in the CMP process. The slurry 17 may include uniformly-sized abrasives.

As illustrated in FIG. 2, pores 14 may form at a surface of the polishing pad 13. During the wafer polishing process, the pores 14 of the polishing pad 13 may be damaged and/or an opening of the pore 14 may be blocked by foreign substances 18. The openings of the pores 14 may also be blocked by the abrasives of the slurry 17 when the slurry 17 solidifies. If the pores 14 are damaged, a polishing rate may be reduced and/or scratches may occur on a surface of wafer, making it difficult to achieve a more stable CMP process. In an attempt to increase the stability of the CMP process, a pad conditioner 19 may be placed in contact with the polishing pad 13 to condition and develop the surface of the polishing pad 13, prior to and after the wafer polishing operation.

A diamond particle layer 19*a* may be formed on a lower surface of the pad conditioner 19. Diamond particles of the pad conditioner 19 may be used to perform a pad condition sweep operation to remove the slurry abrasives and the foreign substances from the pores 14. During the pad condition sweep operation, the diamond particles may be separated from the pad conditioner 19. The separated diamond particles may damage or pollute the surface of the polishing pad 13. Also, the function of removing the slurry abrasives and the foreign substances from the surface of the polishing pad 13 may be ineffective depending on the size of the pores 14.

SUMMARY OF THE INVENTION

Example embodiments of the present invention relate to a semiconductor manufacturing device and a maintenance method thereof. Other example embodiments of the present invention relate to chemical mechanical polishing (CMP) devices capable of performing a pad conditioning operation using megasonic waves, a pad conditioner assembly and a polishing pad conditioning method thereof.

Example embodiments of the present invention provide a chemical mechanical polishing (CMP) device capable of performing a pad conditioning operation using megasonic waves, a polishing pad assembly and a polishing pad conditioning method thereof, which may decrease the susceptibility of pores on a surface of a polishing pad.

Example embodiments of the present invention also provide a CMP device with a pad conditioner, a polishing pad assembly and a polishing pad conditioning method thereof, which may have an increased ability to remove slurry abrasives and/or foreign substances remaining on a surface of a polishing pad.

Example embodiments of the present invention provide CMP devices, a polishing pad assembly and polishing pad conditioning methods thereof, in which a quartz rod having both a megasonic function and a conditioning function may be used to condition a surface of a polishing pad before and after a CMP process, with reduced damage to the polishing pad surface.

In other example embodiments of the present invention, a CMP device for planarizing a wafer is provided. The CMP device may include a carrier, a rotating polishing table and/or a polishing pad. The wafer, which may be mounted on a lower surface of the carrier, may be planarized by rotating the carrier. The carrier may be rotated over the rotating polishing table having a polishing pad attached to an upper surface thereof. The carrier may be rotated over the rotating polishing table while supplying a slurry onto the polishing pad. The CMP device may include a pad conditioner assembly to condition the polishing pad by supplying a pad conditioning liquid onto the polishing pad. A megasonic vibration may be simultaneously transferred to the pad conditioning liquid in order to remove foreign substances from a surface of the polishing pad, while conditioning the polishing pad.

In example embodiments of the present invention, the pad conditioner assembly may include an oscillator generating the megasonic vibration and/or a vibrator yawed (or vibrated) by the megasonic vibration from the oscillator. The vibrator may include a straight-line type rod formed of one selected from the group including quartz, sapphire, silicon carbide, boron nitride, vitreous carbon and a combination thereof. The oscillator may include a power generator receiving a current to generate megasonic vibration energy.

In other example embodiments of the present invention, the pad conditioner assembly may include a first pad conditioner assembly, a second pad conditioner assembly, a first oscillator and/or a second oscillator. The first pad conditioner assembly may include a first vibrator agitating the pad conditioning liquid supplied onto an inner region surrounding the center of the surface of the polishing pad. The first oscillator may apply a first megasonic vibration energy to the first vibrator. The second pad conditioner assembly may include a second vibrator agitating the pad conditioning liquid supplied onto an outer region surrounding the inner region of the surface of the polishing pad. The second oscillator may apply a second megasonic vibration energy to the second vibrator.

In yet other example embodiments of the present invention, a front end of the first vibrator may be located proximal to the center of the polishing pad. A front end of the second vibrator may be located proximal to an interface between the inner region and the outer region of the polishing pad. The first vibrator may be a rod including an inclined or stepped portion formed of one selected from the group including quartz, sapphire, silicon carbide, boron nitride, vitreous carbon and a combination thereof.

In still other example embodiments of the present invention, the second vibrator may be a straight-line type rod formed of one selected from the group including quartz, sapphire, silicon carbide, boron nitride, vitreous carbon, and a combination thereof.

In still other example embodiments of the present invention, the first oscillator and the second oscillator may transfer identical, or different, megasonic vibration energy to the first vibrator and the second vibrator, respectively. The first and second oscillator may simultaneously, or independently, transfer megasonic vibration energy to the first vibrator and the second vibrator, respectively.

In yet other example embodiments of the present invention, the CMP device may further include a nozzle supplying the pad conditioning liquid. The pad conditioning liquid may be one of deionized water (DIW), a solution of DIW mixed with acid or a solution of DIW mixed with potassium hydroxide (KOH).

In example embodiments of the present invention, CMP device may include a rotatable carrier, a rotatable polishing table, a first nozzle, a pad conditioner assembly and/or a power generator. A wafer may be mounted on a lower surface of the rotatable carrier. A polishing pad may be attached to an upper surface of the rotatable polishing table. The first nozzle may supply a slurry onto the polishing pad. The pad conditioner assembly may include a rod transferring a megasonic vibration to a pad conditioning liquid supplied onto the polishing pad to agitate the pad conditioning liquid, removing foreign particles remaining in pores formed at a surface of the polishing pad. The power generator may generate and apply megasonic vibration energy to the rod.

In example embodiments of the present invention, the rod may be formed of one selected from the group including quartz, sapphire, silicon carbide, boron nitride, vitreous carbon and a combination thereof. The rod may be substantially parallel to the polishing pad. The rod may be a straight-line structure extending over at least the center of the polishing pad. The rod may be rotate on an axis of the rod.

In yet other example embodiments of the present invention, the CMP device may include a second nozzle supplying the pad conditioning liquid onto the polishing pad. The pad conditioning liquid may be supplied onto the polishing pad through the first nozzle. The pad conditioning liquid may be one selected from the group including deionized water (DIW), a solution of DIW mixed with acid and a solution of DIW mixed with potassium hydroxide (KOH).

In other example embodiments of the present invention, CMP device may include a rotatable carrier, a rotatable polishing table, a first nozzle, a first pad conditioner assembly, a first power generator, a second pad conditioner assembly and/or a second power generator. A wafer may be mounted to a lower surface of the rotatable carrier. A polishing pad may be attached to an upper surface of the rotatable polishing table. The first nozzle may supply a slurry onto the polishing pad. The first pad conditioner assembly may include a first rod having an inclined portion that agitates a pad conditioning liquid supplied onto an inner region surrounding a center of a surface of the polishing pad. The first power generator may apply megasonic vibration energy to the first rod. The second pad conditioner assembly may include a second rod having a straight-line shape. The second rod may agitate the pad conditioning liquid supplied onto an outer region surrounding the inner region of the surface of the polishing pad. The second power generator may apply megasonic vibration energy to the second rod.

In example embodiments of the present invention, at least one of the first and second rods may be formed of one selected from the group including quartz, sapphire, silicon carbide, boron nitride, vitreous carbon and a combination thereof. A front end of the first rod may be located proximal to the center of the polishing pad. A front end of the second rod may be located proximal to an interface between the inner region and the outer region of the polishing pad.

In further example embodiments of the present invention, the first power generator and the second power generator may simultaneously, or independently, transfer megasonic vibration energy to the first rod and the second rod, respectively. The first power generator and the second power generator may transfer identical, or different, megasonic vibration energies.

In other example embodiments of the present invention, the CMP device may include a second nozzle supplying the pad conditioning liquid onto the polishing pad. The pad conditioning liquid may be supplied onto the polishing pad through the first nozzle. The pad conditioning liquid may be one selected from the group including deionized water (DIW), a solution of DIW mixed with acid and a solution of DIW mixed with potassium hydroxide (KOH).

In still other example embodiments of the present invention, a polishing pad conditioning method may planarizing a wafer, mounted on a lower surface of a rotating carrier, by pressing the rotating carrier against a rotating polishing table. The polishing table may have a polishing pad attached to an upper surface thereof. The polishing pad conditioning method may further include positioning a pad conditioner assembly, having a vibrator and an oscillator, on the polishing pad; supplying a pad conditioning liquid onto the polishing pad; applying a current to the oscillator to generate megasonic vibration energy and/or transferring the megasonic vibration energy to the vibrator to yaw (or vibrate) the vibrator, agitating the pad conditioning liquid supplied onto the polishing pad.

In example embodiments of the present invention, the pad conditioning liquid may be deionized water (DIW) or a solution of DIW mixed with acid or potassium hydroxide (KOH).

In further example embodiments of the present invention, the polishing table, having the polishing pad attached thereto, may be continuously rotated while agitating the pad conditioning liquid supplied onto the polishing pad surface.

In still other example embodiments of the present invention, a polishing pad conditioning method may include planarizing a wafer, mounted on a lower surface of a rotating carrier, by pressing the carrier against a rotating polishing table having a polishing pad. The polishing pad conditioning method may include positioning a first pad conditioner assembly having a first vibrator and a first oscillator in an inner region surrounding a center of a surface of the polishing pad; positioning a second pad conditioner assembly including a second vibrator and a second oscillator in an outer region surrounding the inner region of the surface of the polishing pad; supplying a pad conditioning liquid onto the polishing pad; applying a current to the first and second oscillators to generate megasonic vibration energy and/or transferring the megasonic vibration energy to the first and second vibrators to yaw (or vibrate) the first and second vibrators, agitating the pad conditioning liquid supplied onto the inner and outer regions.

In example embodiments of the present invention, identical or different megasonic vibration energies may be generated to vibrate the first and second vibrators.

In example embodiments of the present invention, the first and second vibrators may vibrate simultaneously, or independently.

In example embodiments of the present invention, the pad conditioning liquid may be deionized water (DIW) or a solution of DIW mixed with acid or potassium hydroxide (KOH).

In still other example embodiments of the present invention, the rotating polishing table having the polishing pad attached to an upper surface thereof may be continuously rotated during the agitation of the pad conditioning liquid supplied onto the inner and outer regions.

The CMP device capable of performing a pad conditioning operation using megasonic waves and a polishing pad conditioning method thereof according to example embodiments of the present invention may provide a more effective pad conditioning method than the conventional polishing pad conditioning device and method using diamond particles. The polishing pad conditioning method according to example embodiments of the present invention may be performed using megasonic energy. As such, contact with the surface of the polishing pad may be reduced (or eliminated), reducing the likelihood of damaging the polishing pad. The lifetime of the polishing pad may be extended and/or replacement of a diamond disk may be unnecessary.

BRIEF DESCRIPTION OF THE DRAWINGS

Example embodiments of the present invention will be more clearly understood from the following detailed description taken in conjunction with the accompanying drawings.

FIG. 1 is a diagram illustrating a sectional view of a conventional CMP device;

FIG. 2 is a diagram illustrating a sectional view of a conventional polishing pad conditioning method;

FIG. 3 is a diagram illustrating a sectional view of a CMP device according to example embodiments of the present invention;

FIG. 4 is a diagram illustrating a sectional view of a polishing pad conditioning method according to example embodiments of the present invention;

FIG. 5 is a diagram illustrating a plan view of a polishing pad conditioning method according to example embodiments of the present invention;

FIG. 6 is a diagram illustrating a sectional view of a polishing pad conditioning method in a CMP device according to example embodiments of the present invention; and FIG. 7 is a diagram illustrating a plan view of a polishing pad conditioning method in a CMP device according to example embodiments of the present invention.

DETAILED DESCRIPTION OF EXAMPLE EMBODIMENTS

Figure 1:
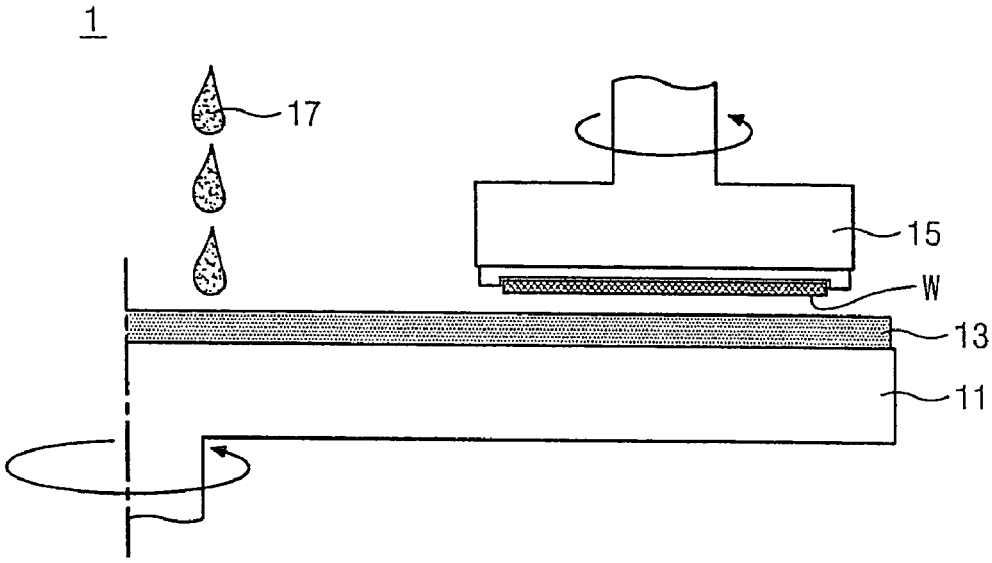
Fig. 1 (CONVENTIONAL ART)
FIGS. 1-7 represent non-limiting, example embodiments of the present invention as described herein.
Figure 2:
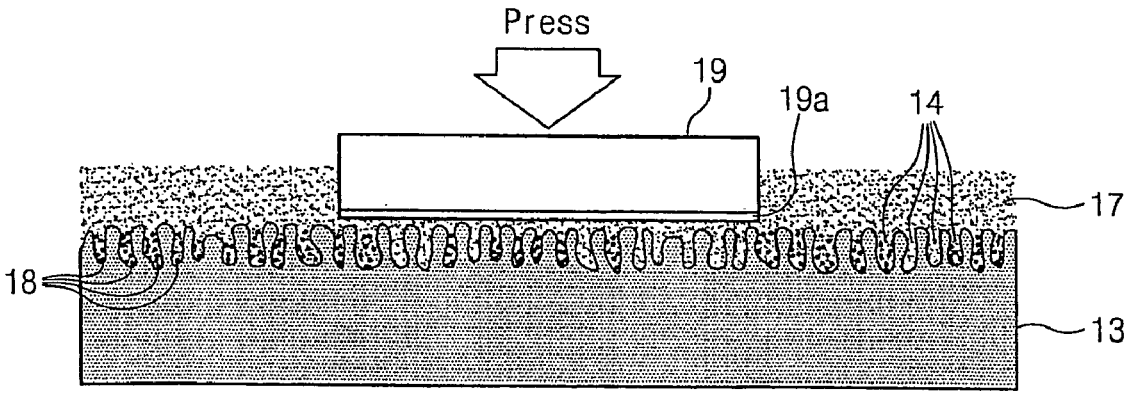
Fig. 2 (CONVENTIONAL ART)

Various example embodiments of the present invention will now be described more fully with reference to the accompanying drawings in which some example embodiments of the invention are shown. In the drawings, the thicknesses of layers and regions may be exaggerated for clarity.

Detailed illustrative embodiments of the present invention are disclosed herein. However, specific structural and functional details disclosed herein are merely representative for purposes of describing example embodiments of the present invention. This invention may, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the scope of example embodiments of the present invention.

Spatially relative terms, such as "beneath," "below," "lower," "above," "upper" and the like, may be used herein for ease of description to describe one element or a relationship between a feature and another element or feature as illustrated in the figures. It will be understood that the spatially relative terms are intended to encompass different orientations of the device in use or operation in addition to the orientation depicted in the Figures. For example, if the device in the figures is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly.

Example embodiments of the present invention are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments of the invention should not be construed as limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope of the present invention.

It should also be noted that in some alternative implementations, the functions/acts noted may occur out of the order noted in the figures. For example, two figures shown in succession may in fact be executed substantially concurrently or may sometimes be executed in the reverse order, depending upon the functionality acts involved.

Unless otherwise defined, all terms (including technical and scientific terms) used herein have the same meaning as commonly understood by one of ordinary skill in the art to which example embodiments of the present invention belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In order to more specifically describe example embodiments of the present invention, various aspects of the present invention will be described in detail with reference to the attached drawings. However, the present invention is not limited to the example embodiments described.

Example embodiments of the present invention relate to a semiconductor manufacturing device and a maintenance method thereof. Other example embodiments of the present invention relate to chemical mechanical polishing (CMP) devices capable of performing a pad conditioning operation using megasonic waves, a pad conditioner assembly, and a polishing pad conditioning method thereof.

Chemical mechanical polishing (CMP) devices, a pad conditioner assembly and polishing pad conditioning methods thereof according to example embodiments of the present invention will now be described in detail with reference to FIGS. 3 through 7.

Figure 3:
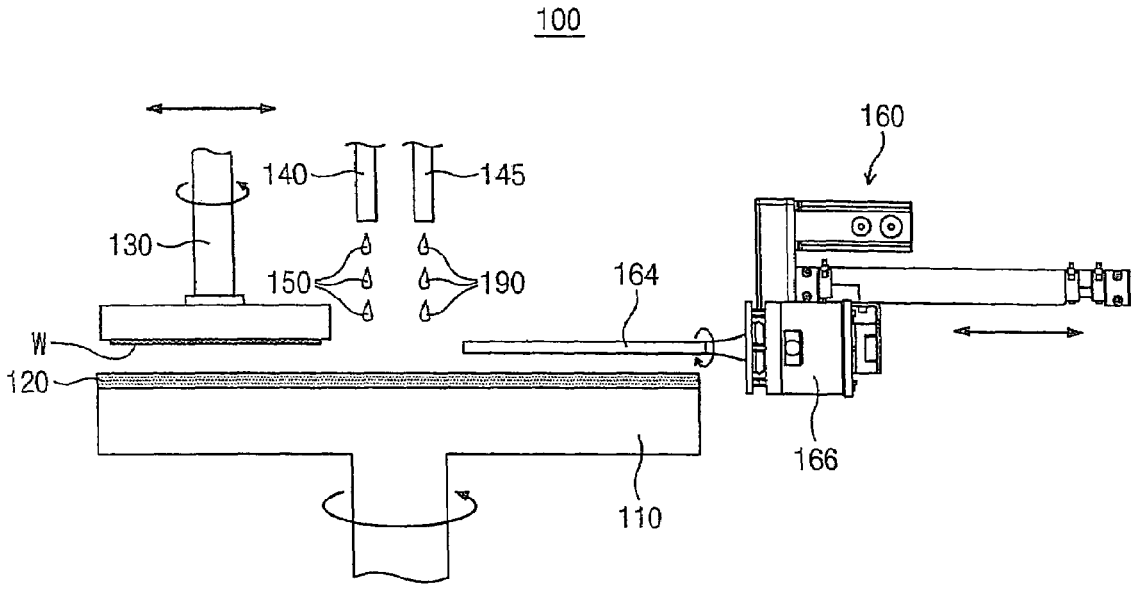

Referring to FIG. 3, a CMP device 100 may include a rotatable carrier 130, a rotatable polishing table 110 and/or a slurry supplying nozzle 140. A wafer W may be mounted on a lower surface of the rotatable carrier 130. A polishing pad 120 may be attached to an upper surface of the rotatable polishing table 110. A slurry supplying nozzle 140 may supply a slurry 150 onto an upper surface of the polishing pad 120. The slurry 150 may include at least one abrasive (e.g., silica, alumina, ceria and zirconia). The CMP device 100 may be used to perform a CMP process on the wafer W. According to the CMP process, the rotatable carrier 130 may rotate while the wafer W mounted to the rotatable carrier 130 is pressed onto and simultaneously moved over the rotatable polishing table 110, which may be rotating and have the polishing pad 120 attached thereon. As such the wafer W may be polished and planarized. To reduce the likelihood of a polishing rate decreasing due to repetition of the CMP process, the CMP device 100 may also include a pad conditioner assembly 160 for conditioning the polishing pad 120. The CMP device 100 may include a nozzle 145 which supplies a pad conditioning liquid 190 onto the polishing pad 120. As will be described below, the pad conditioner assembly 160 may remove foreign substances from the polishing pad 120 using megasonic vibration energy.

Figure 4:
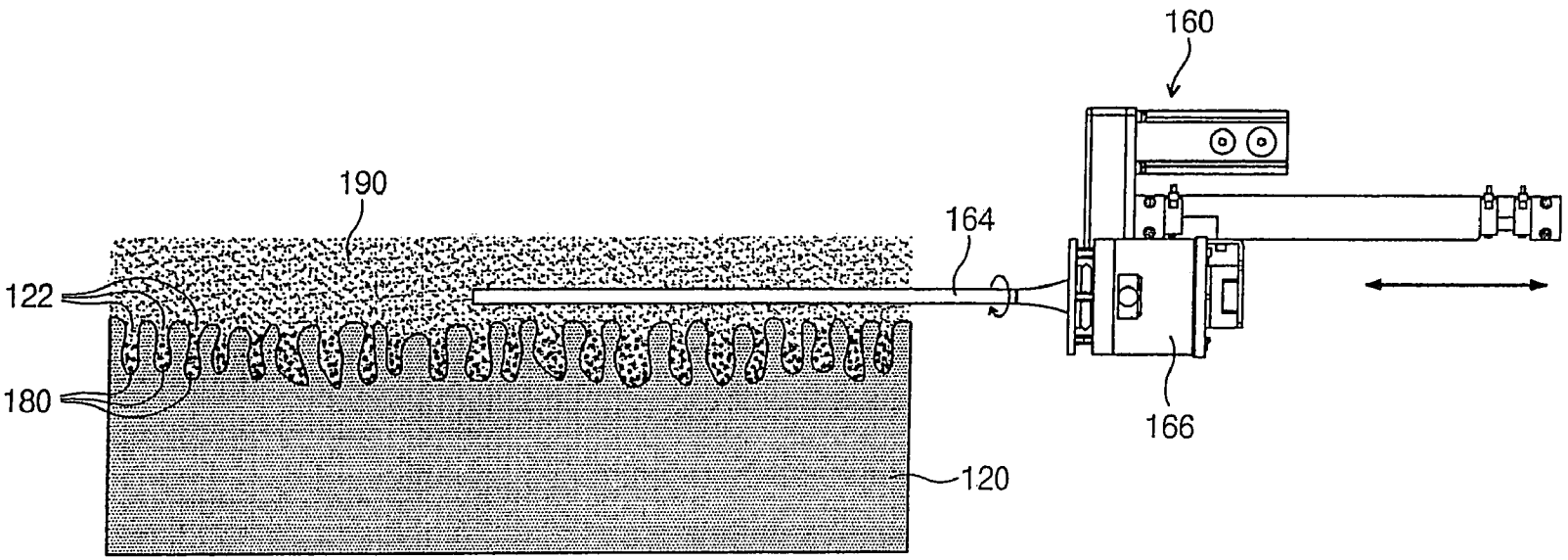

Referring to FIG. 4, megasonic vibration energy may be used to more easily and more effectively remove foreign substances 180 and/or abrasives of a slurry that may fill pores 122 formed at a surface of the polishing pad 120 attached on an upper surface of the rotatable polishing table 110 of the CMP device 100. The pad conditioner assembly 160 may include a vibrator 164 and an oscillator 166. The vibrator 164 may to transfer megasonic vibration energy to the pad conditioning liquid 190 supplied onto the polishing pad 120. The oscillator 166 may generate vibration energy to be transferred to the vibrator 164.

The oscillator 166 may be coupled to one end of the vibrator 164. The oscillator 166 may be a power generator that generates megasonic energy (e.g., a high frequency of MHz). The power generator may be configured with a piezoelectric transducer that transduces electrical energy into vibration energy. When power is applied to the oscillator 166, the oscillator 166 may generate and apply megasonic vibration energy to the vibrator 164, causing the vibration (or yawing motion) of the vibrator 164. The vibrator 164 may generate and transfer vibration energy to the polishing pad 120.

The pad conditioning liquid 190 may be agitated by the vibration energy of the vibrator 164, removing the foreign substances 180 from the pores 122 of the polishing pad 120. The pad conditioning liquid 190 may be deionized water (DIW). For more effective conditioning, the pad conditioning liquid 190 may be a solution of DIW mixed with a catalyst (e.g., acid or base such as potassium hydroxide (KOH)). The pad conditioning liquid 190 may be provided through the slurry supplying nozzle 140 or another nozzle 145.

The vibrator 164 may contact the pad conditioning liquid 190 provided on the polishing pad 120. The vibrator 164 may have a hollow rod shape that has a round section and extends in a desired direction. The round section may have a constant size throughout the entire length of the rod. The round section may decrease toward an end of the rod. In addition to being round, the round section of the rod may have any shape suitable for agitating the pad conditioning liquid 190.

The vibrator 164 may be formed of quartz capable of more effectively transferring megasonic energy. The vibrator 164 may be a hollow quartz rod. The vibrator 164 formed of quartz may be used for most liquids. The vibrator 164 may be damaged by the pad conditioning liquid 190 containing fluoric acid. Therefore, the vibrator 164 may be formed of one selected from the group including sapphire, silicon carbide, boron nitride, vitreous carbon and a combination thereof.

The vibrator 164 may be yawed (or vibrated) to apply a stronger megasonic vibration to the pad conditioning liquid 190 provided on the polishing pad 120. When megasonic vibration energy is applied to the vibrator 164, the vibrator 164 may generate a stronger megasonic vibration. Compressive and expansive forces due to the megasonic vibration may repeatedly act on the pad conditioning liquid 190. During the period when the expansive force acts on the pad conditioning liquid 190, fine bubbles may be generated in the pad conditioning liquid 190. The fine bubbles may increase in size. During the period when the compressive force acts on the pad conditioning liquid 190, the fine bubbles may collapse generating a stronger impulsive force. The generated impulsive force may remove the slurry abrasives and/or the foreign substances 180 from the pores 122 of the polishing pad 120. The foreign substances 180 may be more effectively removed from the surface of the polishing pad 120 without the damage and/or abrasion of the polishing pad 120, conditioning the polishing pad 120. The vibrator 164 may be soaked in the pad conditioning liquid 190 such that the foreign substances 180 may be more effectively removed from the pores 122.

The vibrator 164 may be configured to rotate an axis of the quartz rod. The pad conditioner assembly 160 may move side-to-side, up and down, etc. When it is unnecessary to perform the pad conditioning operation, the pad conditioner assembly 160 may be located distant from the polishing pad 120.

Figure 5:
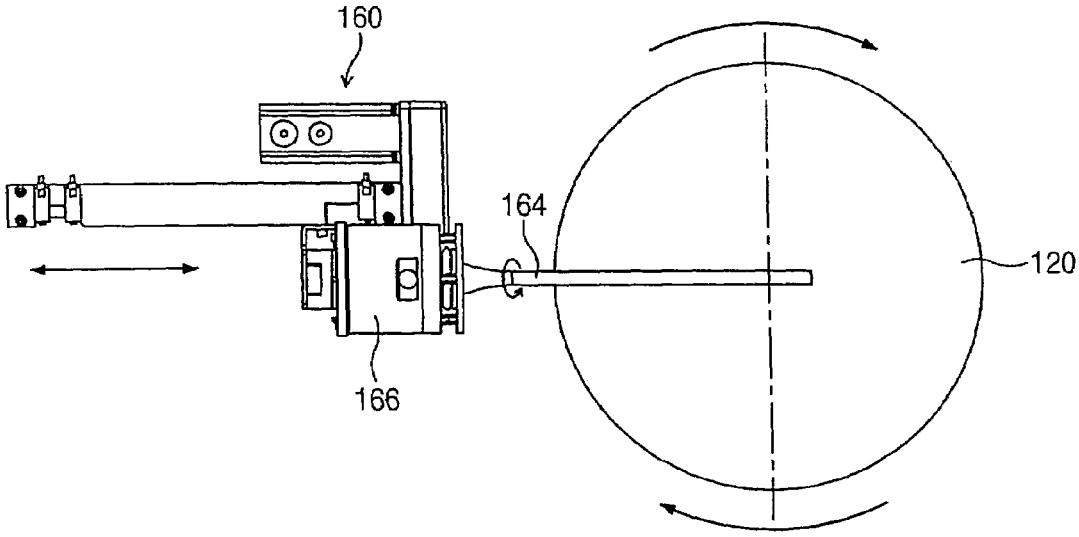

Upon completion of the CMP process, the pad conditioner assembly 160 may move toward the polishing pad 120 to perform the pad conditioning operation. Referring to FIG. 5, in the polishing pad conditioning method, the pad conditioner assembly 160 may be positioned such that the vibrator 164 is over the polishing pad 120, after the wafer is polished. The vibrator 164 may be substantially parallel to the polishing pad 120. In order to more effectively condition the surface of the polishing pad 120, the vibrator 164 may be moved over at least a center of a polishing pad 120. The polishing pad 120 may be rotated. When the vibrator 164 is positioned over at least the center of the polishing pad 120, a current may applied to the power generator 166 generating megasonic vibration energy at the oscillator 166. The megasonic vibration energy may cause the vibrator 164 to yaw (or vibrate). The yawing motion of the vibrator 164 may agitate the pad conditioning liquid 190 supplied onto the polishing pad 120. The foreign substances 180 may be removed from the pores 122 formed at the surface of the polishing pad 120, conditioning the polishing pad 120.

Figure 6:
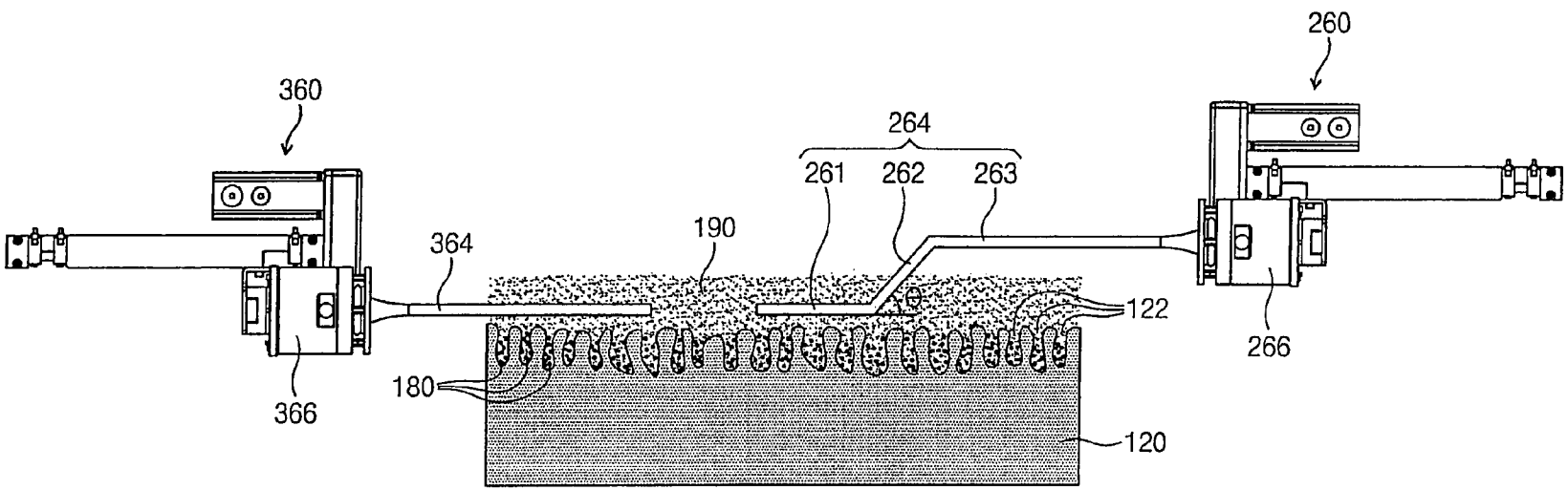

A CMP device according to example embodiments of the present invention will now be described. The CMP device is similar to the example embodiments illustrated in FIG. 3. Therefore, a detailed description of the similarities between FIG. 3 and the CMP device described below will be omitted for the sake of brevity. Referring to FIG. 6, the CMP device may include a plurality of pad conditioner sub-assemblies (e.g., first pad conditioner assembly 260 and second pad conditioner assembly 360) for transferring megasonic energy to different regions of the polishing pad 120. The first pad conditioner assembly 260 may include a first vibrator 264 and a first oscillator 266. The second pad conditioner assembly 360 may include a second vibrator 364 and a second oscillator 366. The first vibrator 264 and the second vibrator 364 may be quartz rods. The first oscillator 266 and the second oscillator 366 may be power generators.

Figure 7:
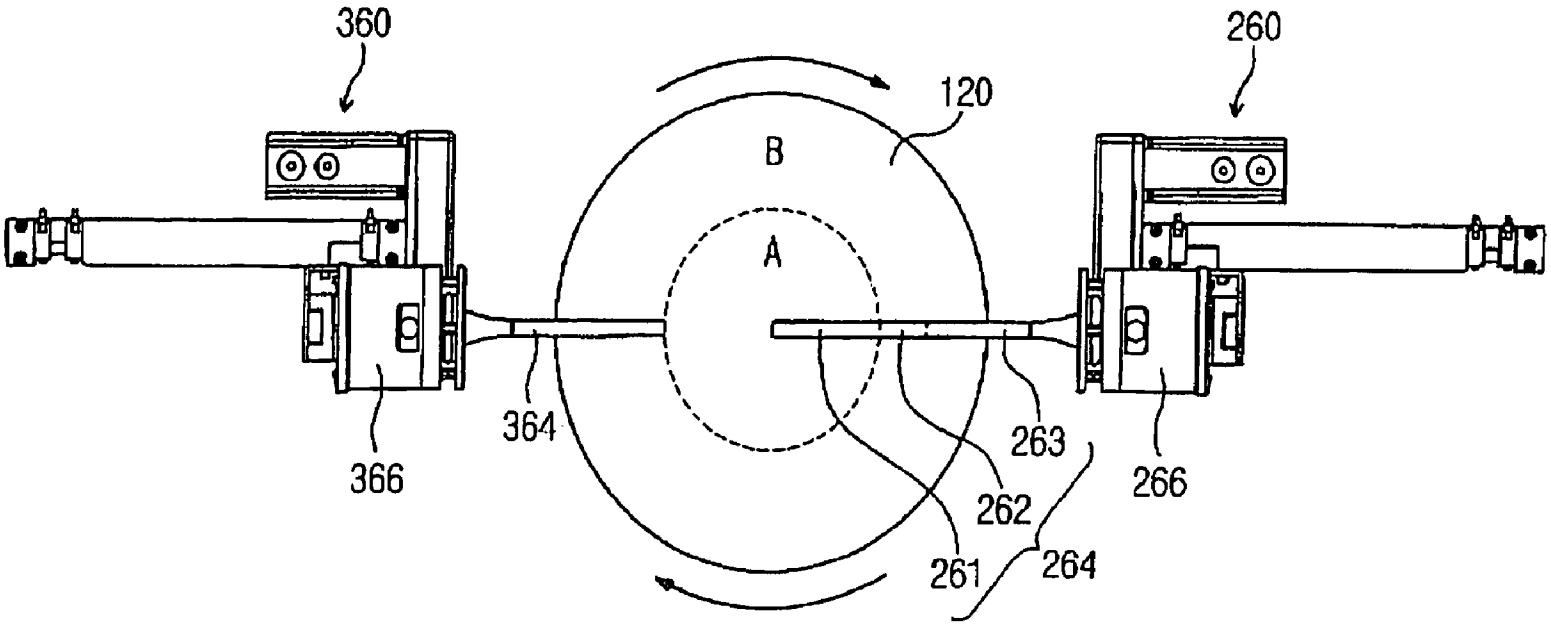

Referring to FIG. 7, the first pad conditioner assembly 260 may be configured to transfer megasonic energy to the pad conditioning liquid 190 supplied onto an inner region A of the surface of the polishing pad 120. The inner region A may surround a center of the polishing pad 120. The first vibrator 264 may include a contact portion 261, a connecting portion 262 and/or a non-contact portion 263. The contact portion 261 may be soaked in, or contacted, by the pad conditioning liquid 190 supplied onto the inner region A. The non-contact portion 263 may be formed over, but not in contact with, the pad conditioning liquid 190 supplied on an outer region B of the surface of the polishing pad 120. The connecting portion 262, which is inclined at an angle θ, may connect to the contact portion 261 and the non-contact portion 263. The inclined angle θ of the connecting portion 262 may be larger than 0° and equal to or smaller than 90° ($0° < \theta \leqq 90°$). When the inclined angle θ is about 90°, the first vibrator 264 may be a step (or inclined) structure such that the connecting portion 262 forms a right angle with the contact portion 261 and non-contact portion 263.

The contact portion 261 of the first vibrator 264 may have a desired length. When considering a desired length of the second vibrator 364 and factors necessary to achieve a more uniform conditioning effect, the desired length of the contact portion 261 may be about half of a radius of the polishing pad 120. When the desired length of the contact portion 261 is about half of the radius of the polishing pad 120, a front end of the contacting portion 261 may be positioned near the center of the polishing pad 120. An opposite end of the contacting portion 261 may be positioned near the interface between the inner region A and the outer region B of the polishing pad 120.

The second pad conditioner assembly 360 may be configured to transfer megasonic energy to the pad conditioning liquid 190 supplied onto the outer region B surrounding the inner region A of the polishing pad 120. The second vibrator 364 may be configured to have a straight-line structure including a contact portion that is soaked in, or contacted by, the pad conditioning liquid 190 supplied onto the outer region B. The contact portion of the second vibrator 364 may have any desired length. When considering the desired length of the first vibrator 264 and factors necessary to achieve a more uniform conditioning effect, the desired length of the contact portion of the second vibrator 364 may be about half of the radius of the polishing pad 120. A front end of the second vibrator 364 may be positioned near the interface between the inner region A and the outer region B of the polishing pad 120.

The first oscillator 266 of the first pad conditioner assembly 260 and the second oscillator 366 of the second pad conditioner assembly 360 may generate a megasonic vibration having a same frequency. The first oscillator 266 of the first pad conditioner assembly 260 and the second oscillator 366 of the second pad conditioner assembly 360 may generate megasonic vibrations having different frequencies. The first vibrator 264 and the second vibrator 364 may operate simultaneously, or independently. For example, the first oscillator 266 and the second oscillator 366 may simultaneously, or independently, transfer megasonic vibrations having the same frequency, or different, frequencies to the first vibrator 264 and second vibrator 364, respectively. The entire surface region of the polishing pad 120 may be conditioned simultaneously, or the inner region A and the outer region B may be conditioned independently. If necessary, the inner and outer regions A and B may be conditioned separately.

The above-described example embodiments of the present invention may provide a more effective pad conditioning operation, assembly and CMP device than the conventional polishing pad conditioning device and method using diamond particles. The polishing pad conditioning method according to example embodiments of the present invention may be performed using megasonic energy. As such, there is minimal (if any) contact with the surface of the polishing pad, reducing the likelihood of damaging the polishing pad. The lifetime of the polishing pad may be extended and/or replacement of a diamond disk may be unnecessary. The polishing pad may be used semi-permanently, reducing manufacturing cost and providing a more stable CMP process.

The foregoing is illustrative of example embodiments of the present invention and is not to be construed as limiting thereof. Although a few example embodiments of the present invention have been described, those skilled in the art will readily appreciate that many modifications are possible in example embodiments without materially departing from the novel teachings and advantages of the present invention. Accordingly, all such modifications are intended to be included within the scope of this invention as defined in the claims. In the claims, means-plus-function clauses are intended to cover the structures described herein as performing the recited function, and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. A chemical mechanical polishing (CMP) device, comprising:

a pad conditioner assembly conditioning a polishing pad by supplying a pad conditioning liquid onto the polishing pad and simultaneously transferring a megasonic vibration to the pad conditioning liquid to remove foreign substances from a surface of the polishing pad, the pad conditioner assembly including a first pad conditioner assembly including a first vibrator agitating the pad conditioning liquid supplied on an inner region of the surface of the polishing pad surrounding a center of the surface of the polishing pad, a first oscillator applying a first megasonic vibration energy to the first vibrator, a second pad conditioner assembly including a second vibrator agitating the pad conditioning liquid supplied onto an outer region of the surface of the polishing pad surrounding the inner region, and a second oscillator applying a second megasonic vibration energy to the second vibrator, wherein the CMP device planarizes a wafer, which is mounted to a lower surface of a carrier, by rotating the carrier over the polishing pad attached to an upper surface of a rotating polishing table while supplying a slurry on the polishing pad.

2. The CMP device of claim 1, wherein: the first oscillator generates a first megasonic vibration, the second oscillator generates a second megasonic vibration, the first vibrator is vibrated by the first megasonic vibration from the first oscillator, and the second vibrator is vibrated by the second megasonic vibration from the second oscillator.

3. The CMP device of claim 2, wherein the first and second vibrators include a straight-line type rod formed of one selected from the group including quartz, sapphire, silicon carbide, boron nitride, vitreous carbon and a combination thereof.

4. The CMP device of claim 2, wherein the first and second oscillators include a power generator receiving a current to generate megasonic vibration energy.

5. The CMP device of claim 1, wherein a front end of the first vibrator is proximal to the center of the surface of the polishing pad; and a front end of the second vibrator is proximal to an interface between the inner region and the outer region.

6. The CMP device of claim 5, wherein the first vibrator is a rod having a stepped portion formed of one selected from the group including quartz, sapphire, silicon carbide, boron nitride, vitreous carbon and a combination thereof.

7. The CMP device of claim 5, wherein the second vibrator is a straight-line type rod formed of one selected from the group including quartz, sapphire, silicon carbide, boron nitride, vitreous carbon and a combination thereof.

8. The CMP device of claim 1, wherein the first oscillator and the second oscillator simultaneously transfer the first and second megasonic vibration energy to the first vibrator and the second vibrator, respectively; and the first megasonic vibration energy and the second megasonic vibration energy are identical.

9. The CMP device of claim 1, wherein the first oscillator and the second oscillator simultaneously transfer the first and second megasonic vibration energy to the first vibrator and the second vibrator, respectively; and the first vibration energy and the second megasonic vibration energy are different.

10. The CMP device of claim 1, wherein the first oscillator and the second oscillator independently transfer the first and second megasonic vibration energy to the first vibrator and the second vibrator, respectively; and the first megasonic vibration energy and the second megasonic vibration energy are identical.

11. The CMP device of claim 1, wherein the first oscillator and the second oscillator independently transfer the first and second megasonic vibration energy to the first vibrator and the second vibrator, respectively; and the first megasonic vibration energy and the second megasonic vibration energy are different.

12. The CMP device of claim 1, further comprising a nozzle supplying the pad conditioning liquid.

13. The CMP device of claim 1, wherein the pad conditioning liquid is one selected from the group including deionized water (DIW), a solution of DIW mixed with acid and a solution of DIW mixed with potassium hydroxide (KOH).

14. A pad conditioner assembly, comprising:

a first pad conditioner sub-assembly including a first rod and a first power generator, wherein the first rod transfers a megasonic vibration to a pad conditioning liquid supplied onto a polishing pad to agitate the pad conditioning liquid in order to remove foreign particles remaining in pores formed at a surface of the polishing pad, the first rod extending in a direction parallel to the surface of the polishing pad, the first rod having an inclined portion agitating the pad conditioning liquid supplied onto an inner region surrounding a center of the surface of the polishing pad, and the first power generator generating and applying a first megasonic vibration energy to the first rod; and a second pad conditioner sub-assembly including a second rod having a straight-line shape agitating the pad conditioning liquid supplied onto an outer region surrounding the inner region, and a second power generator applying a second megasonic vibration energy to the second rod.

15. The assembly of claim 14, wherein the first rod is formed of one selected from the group including quartz, sapphire, silicon carbide, boron nitride, vitreous carbon, and a combination thereof; and the first rod has a straight-line structure extending over a center of the polishing pad.

16. The assembly of claim 14, wherein the first rod is rotatable on an axis thereof.

17. The assembly of claim 14, wherein the pad conditioning liquid is one selected from the group including deionized water (DIW), a solution of DIW mixed with acid and a solution of DIW mixed with potassium hydroxide (KOH).

18. A chemical mechanical polishing (CMP) device comprising:

a rotatable carrier having a wafer mounted on a lower surface thereof;

a rotatable polishing table having the polishing pad attached on an upper surface thereof;

a first nozzle supplying a slurry onto the polishing pad; and the pad conditioner assembly according to claim 14.

19. The CMP device of claim 18, further comprising a second nozzle supplying the pad conditioning liquid onto the polishing pad.

20. The CMP device of claim 18, wherein the pad conditioning liquid is supplied onto the polishing pad through the first nozzle.

21. The assembly of claim 14, wherein at least one of the first rod and the second rod is formed of one selected from the group including quartz, sapphire, silicon carbide, boron nitride, vitreous carbon and a combination thereof.

22. The assembly of claim 14, wherein a front end of the first rod is proximal to the center of the polishing pad; and a front end of the second rod is proximal to an interface between the inner region and the outer region of the polishing pad.

23. The assembly of claim 22, wherein the first power generator and the second power generator simultaneously transfer the first and second megasonic vibration energy to the first rod and the second rod, respectively.

24. The assembly of claim 22, wherein the first power generator and the second power generator independently transfer the first and second megasonic vibration energy to the first rod and the second rod, respectively.

25. The CMP device of claim 18, wherein the pad conditioning liquid is one selected from the group including deionized water (DIW), a solution of DIW mixed with acid and a solution of DIW mixed with potassium hydroxide (KOH).

26. A polishing pad conditioning method, comprising:

planarizing a wafer mounted on a lower surface of a rotating carrier by pressing the rotating carrier against a rotating polishing table having a polishing pad attached to an upper surface thereof;

positioning a first pad conditioner assembly including a first vibrator and an first oscillator onto an inner region of an upper surface of the polishing pad surrounding a center of the upper surface of the polishing pad;

positioning a second pad conditioner assembly including a second vibrator and a second oscillator onto an outer region of the surface of the polishing pad surrounding the inner region of an upper surface of the polishing pad;

supplying a pad conditioning liquid onto the polishing pad;

applying a first current to the first oscillator to generate a first megasonic vibration energy;

transferring the first megasonic vibration energy to the first vibrator to vibrate the first vibrator, agitating the pad conditioning liquid supplied onto the inner region of the upper surface of the polishing pad;

applying a second current to the second oscillator to generate a second megasonic vibration energy; and transferring the second megasonic vibration energy to the second vibrator to vibrate the second vibrator, agitating the pad conditioning liquid supplied onto the outer region of the upper surface of the polishing pad.

27. The polishing pad conditioning method of claim 26, wherein the pad conditioning liquid is one selected from the group including deionized water (DIW), a solution of DIW mixed with acid and a solution of DIW mixed with potassium hydroxide (KOH).

28. The polishing pad conditioning method of claim 26, wherein the rotatable polishing table is continuously rotated while agitating of the pad conditioning liquid supplied onto the polishing pad.

29. The polishing pad conditioning method of claim 26, wherein the second current and the first current are applied simultaneously, and the second megasonic vibration energy and the first megasonic vibration energy are transferred simultaneously.

30. The polishing pad conditioning method of claim 29, wherein the first megasonic vibration energy and the second megasonic vibration energy are generated during the generating of a megasonic vibration energy to vibrate the first and second vibrators, respectively; and the first megasonic vibration energy and the second megasonic vibration energy are identical.

31. The polishing pad conditioning method of claim 29, wherein the first megasonic vibration energy and the second megasonic vibration energy are generated during the generating of a megasonic vibration energy to vibrate the first and second vibrators, respectively; and the first megasonic vibration energy and the second megasonic vibration energy are different.

32. The polishing pad conditioning method of claim 29, wherein the first and second vibrators are simultaneously vibrated.

33. The polishing pad conditioning method of claim 29, wherein the first and second vibrators are independently vibrated.

34. The polishing pad conditioning method of claim 29, wherein the rotating polishing table is continuously rotated during the agitating of the pad conditioning liquid.

35. The pad conditioner assembly of claim 23, wherein the first rod is capable of rotating in a direction perpendicular to the surface of the polishing pad.

* * * * *